United States Patent [19]

Lening et al.

[11] 4,387,916

[45] Jun. 14, 1983

[54] GATE LATCH ASSEMBLY

[76] Inventors: George O. Lening, 4535 Elm St., Chino, Calif. 91710; James B. Lening, 705 Locust, Ontario, Calif. 91761

[21] Appl. No.: 163,095

[22] Filed: Jun. 26, 1980

[51] Int. Cl.[3] ..... E05C 3/06

[52] U.S. Cl. ..... 292/5; 292/205

[58] Field of Search ..... 292/4, 5, 214, 213, 292/205, 227, 68, 218

[56] References Cited

U.S. PATENT DOCUMENTS

| | | | |
|---|---|---|---|
| 1,326,554 | 12/1919 | Watson | 292/205 X |
| 1,538,056 | 5/1925 | Olson | 292/214 X |
| 3,857,593 | 12/1974 | Lening | 292/5 |

FOREIGN PATENT DOCUMENTS

| | | | |
|---|---|---|---|
| 2324617 | 12/1974 | Fed. Rep. of Germany | 292/227 |

*Primary Examiner*—Richard E. Moore

*Attorney, Agent, or Firm*—Boniard I. Brown

[57] ABSTRACT

A latch assembly for a hinged double gate structure including a pair of hinged gates swingable to and from a closed position wherein the gates are disposed in substantially coplanar relationship with a vertical edge of a first gate adjacent to a vertical edge of a second gate. The latch includes a normally generally vertical latch rod having an upper end. A mounting bracket slidably receives the rod and attaches the bracket to the edge of the first gate with the rod extending along the edge thereof. The rod is restrained from rotation on its longitudinal axis. A latch yoke includes a pair of spaced yoke arms and is pivotally connected to the rod on a pivot axis transverse to the rod for pivotal motion of the yoke between a gate latching position wherein the yoke arms extend transversely of the rod and straddle the edge of the second gate and a gate releasing position wherein the yoke arms extend generally longitudinally of the rod.

3 Claims, 3 Drawing Figures

GATE LATCH ASSEMBLY

BACKGROUND OF THE INVENTION

The invention relates to hinged double gate structures of the kind having two gates hingably supported for swinging between open and closed positions. More particularly the invention relates to a novel latch assembly for such gate structures.

Hinged double gate structures are well known and are commonly used as closures for relatively wide access openings, such as driveway openings through walls or fences. Typically two gates are each hinged along one vertical edge, referred to herein as their inner edges, to vertical supports located at opposite sides of the access openings which may be closed by the gates. Each gate is swingable independently between open and closed positions. In the closed position the gates are disposed in edge to edge generally coplanar relationship across the access opening with their remaining vertical edges, referred to herein as their outer edges, adjacent to one another.

Double gate structures of this kind are latched in the closed position by a latch assembly. The most widely used latch assembly for this purpose has a latch rod slidably and rotatably supported by brackets which are attached to the outer edge of one gate. The lower end of this rod cooperates with a latch socket or the like imbedded in the ground in a position to receive the rod when the gate on which it is carried is disposed in the closed position. The latch rod and one rod bracket, carried on the rod, have coacting anti-rotation means which engage to lock the rod against rotation about the longitudinal axis of the rod when it is disposed in latching position in the socket. These anti-rotation means disengage to release the rod for rotation when the rod is elevated or retracted from a latching position.

Rigidly joined to the upper end of the latch rod is a latch yoke having spaced latch arms extending transversely of the rod. When the latch rod is disposed in the latching position with its anti-rotation means engaged, each yoke arm extends away from the gate mounting the rod and also in generally parallel relationship to the plane of the gate mounting the rod. In this position of the yoke, its latching position, the yoke arms are disposed in straddling relationship to the outer edge of the other gate when it is in the closed position.

With the gates closed and both the latch rod and yoke in latching position, the latch assembly latches both gates closed. The gates are released for opening by raising the latch rod from the latching position. This action releases the gate mounting the latch rod by virtue of retraction of the rod from the latch socket and releases the other gate by virtue of release of the rod and yoke to rotate and thereby enabling disengagement of the latter gate from the yoke.

The double gate latch assembly of the kind described has a significant disadvantage in that opening of one gate only while the other gate remains latched in closed position is difficult to accomplish, particularly with one hand, and requires several motions. More particularly, opening of one gate only requires initial elevation of the latch rod from the latching position, swinging of the latter gate from latching engagement with the freely rotatable latch yoke, and return of the yoke and rod to latching position. In the course of opening the one gate, the other gate, that is the gate mounting the latch rod, is also released for opening with the result that the latter gate must be either held in the closed position during this process or returned to the closed position after opening of the one gate.

U.S. Pat. No. 3,857,593, which issued to the applicant herein on Dec. 31, 1974, relates to an improved double gate latch assembly that has a latch rod slidably supported by brackets to be attached to the outer edge of one gate. Mounted on the upper end of this rod is a latch yoke for straddling the outer edge of the other gate when the gates are in closed position. The latch rod is vertically movable to and from a latching position wherein its lower end is disposed for latching engagement in a latch socket or the like imbedded in the ground. In contrast to the conventional latch assembly, however, the latch rod is keyed against rotation about its longitudinal axis throughout the range of axial movement of the rod relative to its supporting brackets. Also, the latch yoke is pivotally attached to the upper end of the latch rod on a transverse pivot axis. When the rod is mounted along the outer edge of one gate, the yoke pivot axis is generally normal to the plane of the gate and the yoke arms generally parallel to this plane.

When the gate structure is latched closed the lower end of the latch rod engages in the ground imbedded latch socket to latch close the gate which mounts the rod. The latch yoke extends horizontally away from the gate which mounts the rod and straddles the outer edge of the other gate. Since the latch rod is restrained against rotation, the latter gate is also then latched closed. Means are provided for locking the latch rod and yoke in these latching positions and thereby locking the gates closed.

The gate straddled by the latch yoke is released for opening without unlatching the other gate by simply swinging the yoke from its horizontal latching position. Both gates are released for opening simultaneously by retracting both the yoke and latch bar from the latching position.

It is an object of the invention to provide apparatus which will be a still further improvement over the prior art and more particularly will, in part, be more simple to manufacture.

It is another object of the invention to provide apparatus which will be convenient and easy to operate.

Still another object of the invention is to provide apparatus which may be installed in less time than the prior art apparatus.

SUMMARY OF THE INVENTION

The foregoing objects and other objects and advantages which shall become apparent from the detailed description of the preferred embodiment are attained in a latch assembly for a hinged double gate structure including a pair of hinged gates swingable to and from a closed position wherein the gates are disposed in substantially coplanar relationship with a vertical edge of a first gate adjacent to a vertical edge of a second gate, which includes a normally generally vertical latch rod having a normally upper end and mounting bracket means slidably receiving the rod including means for attaching the bracket means to the vertical edge of the first gate with the rod extending along the vertical edge of the first gate. Anti-rotation means restrain the rod against rotation on its longitudinal axis relative to the bracket means. A latch yoke includes a pair of spaced yoke arms and a connecting portion joins the arms at one end and a tongue extends from the connecting portion. Means pivotally connect the yoke tongue to the rod on a pivot axis which is transverse to the rod for pivotal motion of the yoke between a gate latching position wherein the yoke arms extend transversely of the rod and straddle the edge of the second gate and a gate releasing position wherein the yoke arms extend generally longitudinally of the rod. Means for locking the latch yoke and latch bar in latching position are also provided and the yoke latching means comprises at least one elongated arm extending from the latch yoke.

The yoke latching means may include a hole disposed in the rod for receiving an associated lock. The hole may be disposed in a portion of the latch rod over which the one elongated arm passes when the yoke tongue is moved between the gate latching position and the gate releasing position. The hole in the rod may be disposed in the normally upper end of the rod and the normally upper end is generally planar.

The elongated arm may be bifurcated. The bifurcated arm may be disposed with elements thereof on opposed sides of the generally planar normally upper end of the rod. The bifurcated arm may be pivotally connected to the normally upper end. The mounting bracket means may include first and second members each having portions disposed around the generally planar upper end of the rod at axially spaced sections thereof. The mounting bracket first and second portions may each include a slot dimensioned and configured for engagement with the generally planar upper end of the rod.

The bifurcated arm may extend around the generally planar axial extremity of the rod. The bifurcated arm may extend around the generally planar normally upper end of the rod and the bifurcated arm may cooperate with the slots in the portions of the mounting bracket means. The anti-rotation means may include the generally planar normally upper end of the rod and the bifurcated arm and the portions of the mounting bracket means. The latch yoke may include a depending skirt.

BRIEF DESCRIPTION OF THE ACCOMPANYING DRAWING

DESCRIPTION OF THE PREFERRED EMBODIMENT

Figure 1:
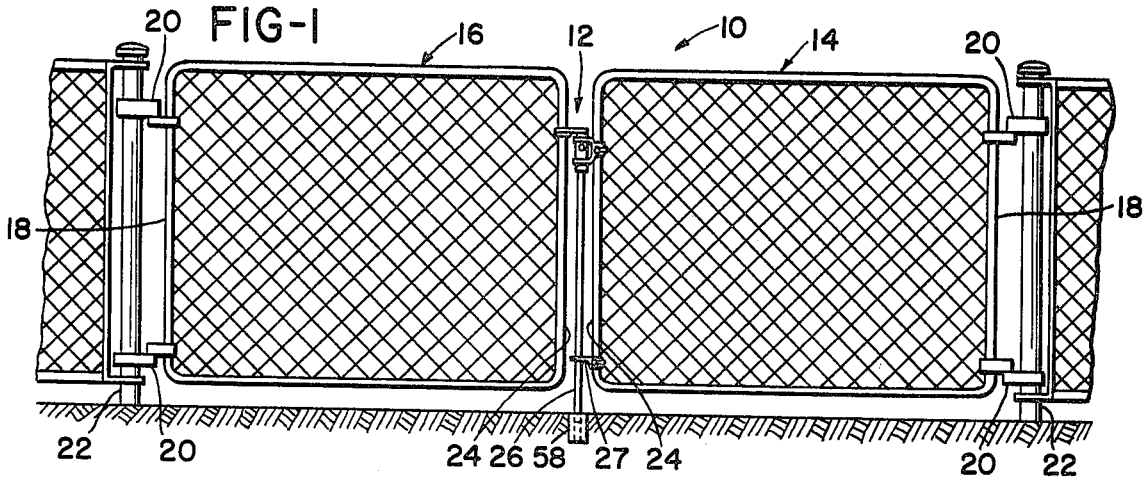
FIG. 1 is a partially schematic elevational view of a double gate structure carrying a latch assembly in accordance with the present invention.
Figure 2:
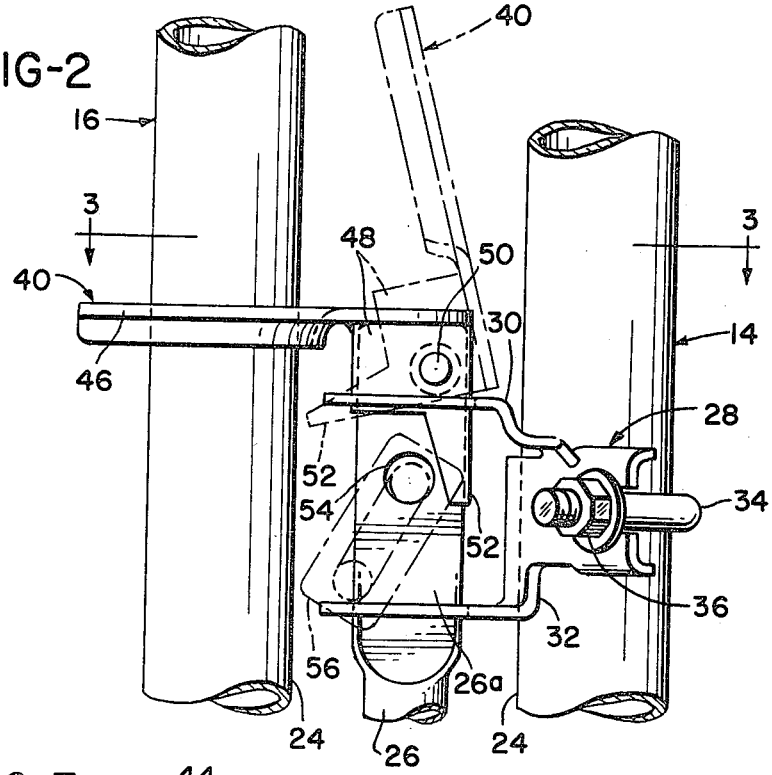
FIG. 2 is an enlarged fragmentary side elevational view of the latch assembly of FIG. 1.
Figure 3:
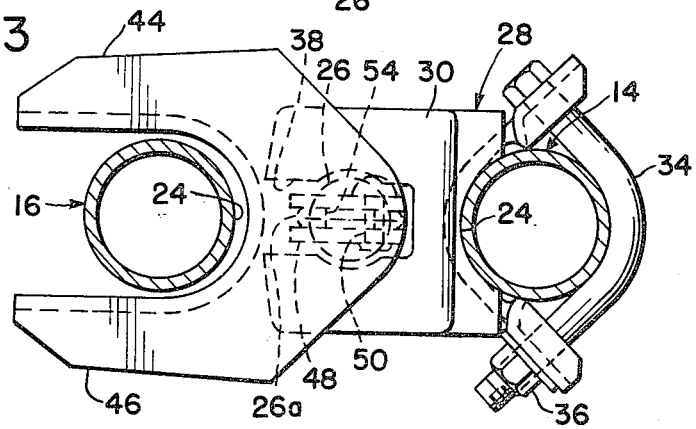
FIG. 3 is a section taken on the line 3—3 of FIG. 2.

Referring now to FIGS. 1, 2, and 3 there is shown a double gate structure 10 which includes an improved latch assembly 12 in accordance with the invention. The gate structure 10 includes a pair of gates 14, 16 attached along their inner edges 18 by hinges 20 to upright supports 22. The gates shown have a chain-link construction. It will be apparent, however, that the latch assembly in accordance with the invention may be utilized on double gate structures having other constructions.

Gates 14, 16 are swingable between open closed positions. In their closed position, as shown in FIG. 1, the gates are disposed in edge-to-edge generally coplanar relation between the supports 22 with the outer gate edges 24 adjacent one another. When the gates 14, 16 are positioned in the open position they are disposed in a generally transverse orientation to the plane of FIG. 1. The latch assembly 12 permits (1) the latching or (2) both latching and locking of both gates in closed position, (3) opening of gate 16 without unlatching of gate 14, or (4) opening of both gates simultaneously.

The latch assembly 12 comprises a normally vertical latch rod 26 which is slidably and non-rotatably carried by mounting bracket assembly 28 which includes first and second portions which are respectively identified by the numerals 30, 32. The second portion 32 cooperates with a generally L-shaped bolt 34 which cooperates with nut 36 to firmly fix the second portion 32 to the outer edge 24 of the gate 14.

The latch rod 26 has an upper end or axial extremity **26*a* which is flattened or generally planar. The generally planar axial extremity 26*a* cooperates indirectly with a slot 38 in the upper portion 30 of the bracket means 28. Similarly the generally planar axial extremity 26*a* cooperates with a slot in the lower portion 32 of the bracket means 28 to prevent rotation of the bar 26 about the axis thereof. It will be understood that the slot (not shown) in the portion 32 will be narrower than the slot 38 in the upper portion 30 of the bracket means 28. More specifically a latch yoke 40 having a pair of spaced yoke arms 44, 46 connected by a tongue 48 is pivotally mounted on the upper axial extremity 26*a* of the bar 26 by a pivot pin 50. A depending arm 52 extends from the tongue 48. As best seen in FIG. 2 the arm 52 extends from the pivot pin 50 so that the path thereof, during pivoting motion of the latch yoke 40, passes over a hole 54. The rod 26 is also guided by an element 27 having a bore (not shown) which is dimensioned for sliding engagement with the rod 26**.

When the latch yoke 40 is disposed in engaged relationship with the gate 16, as shown in solid line in FIG. 2, a padlock 56 may be engaged with the hole 54 where it will prevent movement of the latch yoke 40 to the position shown in dotted line in FIG. 2 and which allows the gate 16 to be opened. Ordinarily the tongue 48, as well as the arm 52, will be bifurcated, as best seen in FIG. 3, and will extend along both sides of the generally planar axial extremity 26. It will thus be seen that the slot 38 in the upper portion 30 of the mounting bracket means must be wider than the corresponding slot in the lower portion 32 of the bracket means 28. More specifically because the arm 52 and tongue 48 do not extend down as far as the lower portion 32 the slot will be much narrower.

From the foregoing description it will be seen that the gate 16 may be opened after removing the padlock 56 merely by raising the latch yoke 40 to the position shown in dotted line in FIG. 2. Both gates may, of course, be secured in place by positioning the padlock 56 within a hole 54. Both gates may be opened by removing the padlock 56 and raising the latch yoke to the position shown in the dotted line in FIG. 2 and then raising the rod 26 until it is out of engagement with the latch socket 58. It will be understood that the operator of the apparatus in accordance with the invention may flip the latch yoke 40 even though he may have bundles in his hands which will allow him only to brush against the latch yoke in order to open the gate. Similarly, after passing through the gate, the person may brush against the latch yoke again to secure the gate 16 in place. It will be further seen that the apparatus in accordance with the invention is not only simple to operate but simple and inexpensive to manufacture.

The invention has been described with reference to its illustrated preferred embodiment. Persons skilled in the art of gate latching apparatus may, upon exposure to the teachings herein, conceive variations in the mechanical development of the components therein. Such variations are deemed to be encompassed by the disclosure, the invention being delimited only by the appended claims.

The inventor claims:

1. A latch assembly for a hinged double gate structure including a pair of hinged gates swingable to and from a closed position wherein the gates are disposed in substantially coplanar relationship with a vertical edge of a first gate adjacent to a vertical edge of a second gate, comprising:

a normally generally vertical latch rod having a normally upper generally planar end portion, mounting bracket means slidably receiving said rod including means for attaching said bracket means to said vertical edge of the first gate with said rod extending along said vertical edge of the first gate, said mounting bracket means including first and second members each having portions disposed about said generally planar upper end portion of said rod at axially spaced sections thereof, each of said members defining a slot dimensioned and configured for engagement with the upper end portion of said rod, anti-rotation means for restraining said rod against rotation on its longitudinal axis relative to said bracket means, a latch yoke having a tongue portion and a pair of spaced yoke arms extending from the tongue portion, means pivotally connecting said yoke tongue to said rod on a pivot axis which is transverse to said rod for pivotal motion of said yoke between a gate latching position wherein said yoke arms extend transversely of said rod and straddle said edge of the second gate and a gate releasing position wherein said yoke arms extend generally longitudinally of said rod, means for latching said latch yoke and latch rod in latching position, said yoke latching means comprising at least one elongated bifurcated arm extending from said latch yoke, and disposed in one of said mounting bracket member slots, and said yoke latching means including a hole in the normally upper end portion of said rod for receiving a lock over which said one elongated arm passes when said yoke tongue is moved between the gate latching position and the gate releasing position, said bifurcated arm being pivotally connected to said upper end of the rod and having elements on opposite sides thereof extending at least partly therearound.

2. The apparatus as described in claim 1, wherein:

said anti-rotation means comprises said generally planar normally upper end of said rod, said bifurcated arm and at least one of said portions of said mounting bracket means.

3. The apparatus as described in claim 2, wherein:

said latch yoke further includes a depending skirt.

* * * * *